US010822875B1

(12) United States Patent
Hailey

(10) Patent No.: US 10,822,875 B1
(45) Date of Patent: Nov. 3, 2020

(54) HANG LADDER WITH TRAILER RUB RAIL BRACKET

(71) Applicant: Michael L. Hailey, Joplin, MO (US)

(72) Inventor: Michael L. Hailey, Joplin, MO (US)

(73) Assignee: Transcorp, LLC, Carthage, MO (US)

( * ) Notice: Subject to any disclaimer, the term of this patent is extended or adjusted under 35 U.S.C. 154(b) by 0 days.

(21) Appl. No.: 16/565,717

(22) Filed: Sep. 10, 2019

Related U.S. Application Data

(60) Provisional application No. 62/729,210, filed on Sep. 10, 2018.

(51) Int. Cl.
*E06C 5/00* (2006.01)
*E06C 5/32* (2006.01)
*E06C 5/02* (2006.01)

(52) U.S. Cl.
CPC . *E06C 5/32* (2013.01); *E06C 5/02* (2013.01)

(58) Field of Classification Search
CPC ... E06C 7/48; E06C 7/165; E06C 1/38; E06C 7/06; E06C 1/22; E06C 7/087
USPC ..... 248/210, 235
See application file for complete search history.

(56) References Cited

U.S. PATENT DOCUMENTS 3,491,852 A 1/1970 Leist
4,482,029 A 11/1984 Prochaska
5,236,062 A 8/1993 Laney
6,044,930 A * 4/2000 Hayman ..... E06C 1/34 182/107
6,578,666 B1 6/2003 Miller
7,066,299 B1 * 6/2006 Fleming ..... E06C 1/20 182/107
7,481,741 B1 * 1/2009 Sammann ..... A63B 9/00 482/35
7,886,872 B2 * 2/2011 Astor ..... E06C 1/28 182/129
8,104,577 B1 1/2012 Reed
8,640,826 B1 2/2014 Beilstein
8,967,650 B1 3/2015 Majors
9,500,026 B2 * 11/2016 Mountain ..... E06C 1/383
9,540,875 B2 * 1/2017 Ellis ..... E06C 1/04
9,593,531 B2 * 3/2017 Ballard ..... E06C 1/36
2002/0189903 A1 12/2002 Krish, Jr.

OTHER PUBLICATIONS

Transportation Innovation Products, Inc, Step-A-Side™ Ladder [online], Jul. 20, 2016. Retrieved from the Internet: <http://web.archive.org/web/20160720223713/http://www.trailerladder.com/>.
Transportation Innovation Products, Inc, Step-A-Side™ Ladder [online], Sep. 16, 2017. Retrieved from the Internet: <http://web.archive.org/web/20170916101753/http://trailerladder.com/>.

* cited by examiner

*Primary Examiner* — Steven M Marsh
(74) *Attorney, Agent, or Firm* — Creativenture Law, LLC; Dennis J M Donahue, III; Kevin Staed

(57) ABSTRACT

A hang ladder is removably mounted to a trailer by a pair of mounting brackets that are attached to the ladder's side rails. The mounting brackets have a body and an arm with a fixed width slot extending between their upper sections and with a flared end at the open end of the slot. The slot is skewed relative to the longitudinal base of the bracket, and the rub rail of a flatbed trailer fits within the slot so that the ladder is secured to the rub rail on the side of the trailer. A tapered end of the arm can produce the flare in the end of the slot.

20 Claims, 4 Drawing Sheets

HANG LADDER WITH TRAILER RUB RAIL BRACKET

CROSS-REFERENCE TO RELATED APPLICATIONS

This application claims priority from U.S. Provisional Patent Application No. 62/729,210 filed on Sep. 10, 2018 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to ladders, and more particularly to hang ladders that have brackets which allow them to be removably mounted to the rub rails of flatbed trailers.

Related Art

It is generally known to provide hang ladders that removably mount to flatbed trailers for access between the bed of the trailer and the ground. Particularly, the hang ladders have brackets that mount to the trailer's rub rail and can easily be removed from their mounted position and stowed when in transit and access is not needed. Most ladders and mounting bracket systems either have a vertical slot that mounts over the rub rail of the trailer or attach a permanent bracket system to the trailer which subsequently receives the ladder. Additionally, some ladders and mounting brackets have a slot with a wider open end than the top end. However, there is no ladder and mounting bracket that has an angled slot along with a taper towards the open end of the slot to ensure the ladder can be used with various rub rails in addition to holding the ladder at the preferred angle for mounting and dismounting a trailer.

There has been a desire for ladders and mounting brackets in the trucking industry that provide an easier and safer way to mount and dismount trailers. Flatbed trailers are typically loaded by a ground crane or overhead crane or from the side by a fork truck, and access to the bed by drivers and workers is needed to assist in the loading and offloading process, especially when positioning the load, securing the load, and/or covering the load with a tarp, as well as to perform repair and other maintenance activities. Trailers may often be accessed from a loading dock, but when no dock is present, it is beneficial to have an easily mountable ladder that ensures safe mounting and dismounting.

There have been previous solutions to provide removable hang ladders with brackets that attach to trailer rub rails. For example, U.S. Pat. No. 8,104,577 which is incorporated by reference describes a mountable ladder in which the mounting bracket has a fixed width slot that slides over the rub rail of a trailer for attaching the ladder. The prior art mounting brackets shown in FIGS. 1A-1D illustrate variations of ladder mounting brackets that have a fixed width slot and could be used in the hang ladder of the '577 Patent.

However, the mounting brackets shown in the drawings and in the '577 Patent do not have a flare in the opening which can make it difficult to mount the ladder on the rub rail.

Other hang ladders for trailers have suggested mounting brackets in which the slot that engages the side of the trailer has a continuous flare from the top section to the wider bottom opening, such as in U.S. Pat. No. 4,482,029 and US Pat. App. Pub. No. 2002/0189903. Accordingly, these ladders can be more easily mounted to the trailer's rub rail and may also be mounted to the sides of trailers of different sizes. However, the flared opening for the mounting brackets in these references progressively widens for the entire length of the slot from the top end to the bottom opening which results in a less secure mounting for the ladder as compared with the brackets which have a fixed width slot.

Mounting brackets with a fixed width slot that is angled relative to the base of the bracket have been used to angle the ladder relative to the side of the trailer bed and to help prevent rotational movement of the ladder during the mounting and dismounting process, such as with the previous version of the Step-A-Side® ladder which is illustrated in FIG. 1D. In operation, the side walls of the angled slot engage the edges of the rub rail and subsequently limit the rotational movement of the ladder and retain ensure the ladder remains at an acute angle when mounted. However, the prior art mounting brackets have a fixed width slot that makes it more challenging to place the bracket over the trailer rub rail and also limits the sizes of rub rails onto which the bracket can be mounted.

There remains a desire for a hang ladder which has a mounting bracket that can quickly be placed over a trailer's rub rail and can securely hold the ladder by limiting rotational movement of the ladder. The bracket for the hang ladder according to the present invention provides a solution that heretofore had not been known or suggested in the prior art.

SUMMARY OF THE INVENTION

The invention described herein is a hang ladder that is removably mounted to the rub rail of a flatbed trailer. The mounting bracket has an arm that extends from the base of the bracket and a slot between the arm and the base that is angled relative to the base and that has a flare at its bottom opening. Since the slot is preferably angled between ten degrees and fifteen degrees (10°-15°) relative to the longitudinal side of the base, the end of the arm has a taper with a taper angle that is between fifteen degrees and twenty degrees (15°-20°) to produce a flare angle between five degrees and ten degrees (5°-10°) relative to the parallel sides of the slot. It is preferred that the taper is on the arm opposite from the base so that the length of the base side of the slot that engages the front face of the rub rail is maximized.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings as briefly described below.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
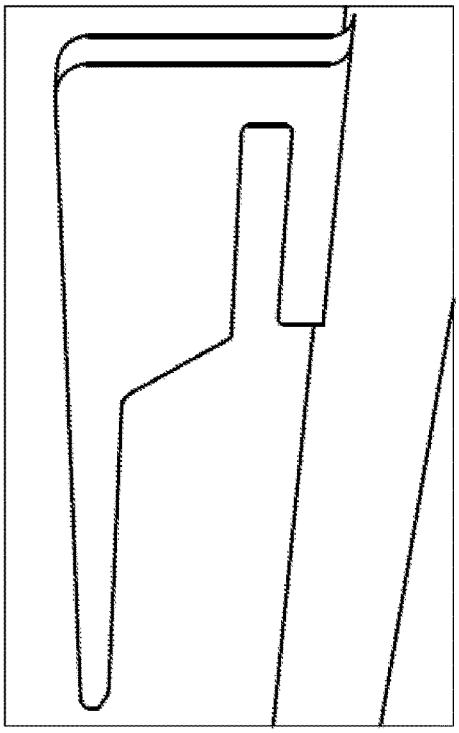
FIG. 1A (PRIOR ART)
FIGS. 1A-1D show prior art mounting brackets for hang ladders.
Figure 1B:
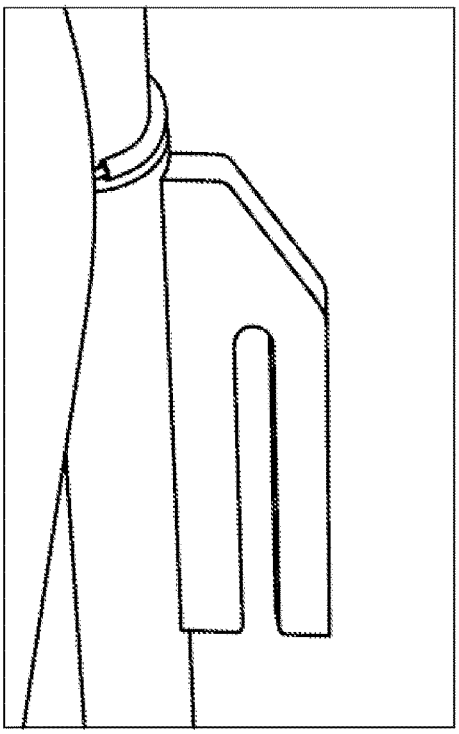
FIG. 1B (PRIOR ART)
Figure 1C:
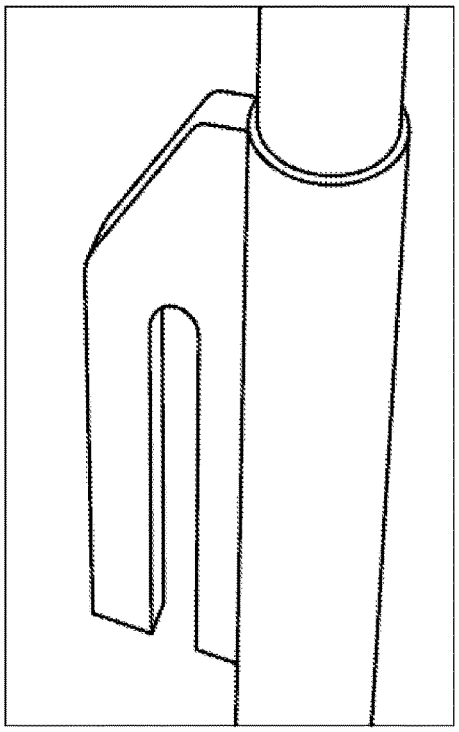
FIG. 1C (PRIOR ART)
Figure 1D:
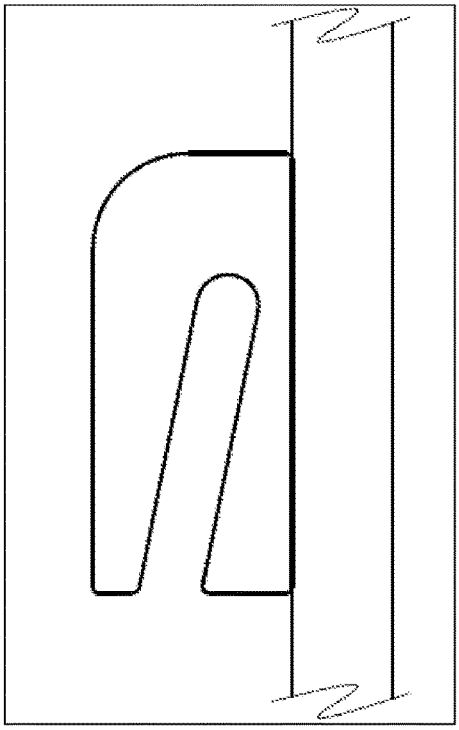
FIG. 1D (PRIOR ART)
Figure 2A:
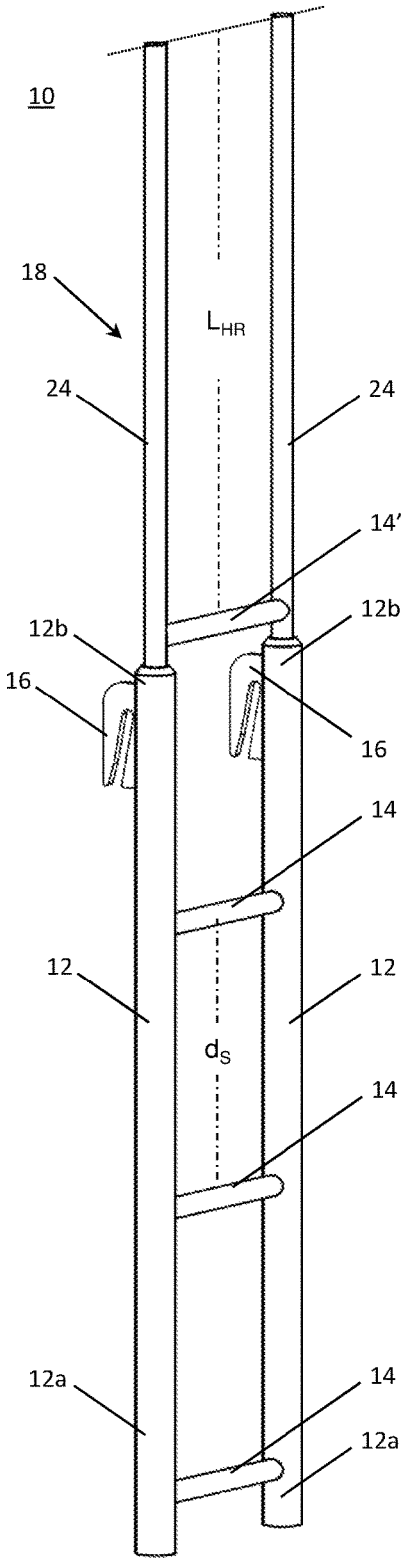
FIGS. 2A and 2B are front and rear perspective views of a hang ladder, respectively, with the mounting bracket according to the present invention.
Figure 2B:
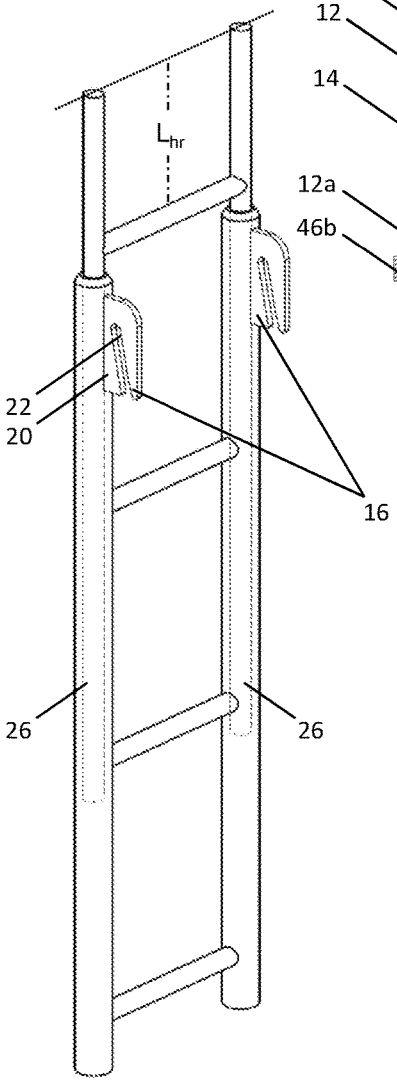

Generally, as shown in FIGS. 2A and 2B, a hang ladder 10 for engaging a trailer's rub rail 100 according to the present invention has a pair of opposing side rails 12 that extend from a bottom section 12*a* to a top section 12*b*, a plurality of rungs 14 extending between and connecting the pair of side rails from the bottom section to the top section, and a pair of brackets 16 respectively attached to the top section of the opposing side rails. Each adjacent pair of rungs are spaced from each other by a step distance ($d_S$), and each of the pair of brackets has a body 20 and an arm 22 extending from the body. The ladder also preferably has an extension section 18 which includes a pair of handle rails 24 that extend from the opposing side rails and also includes at least one additional rung 14' extending between and connecting the handle sections proximate to one end of the pair of handle rails. The length of the handle rails' long end ($L_{HR}$) is greater than twice the step distance (i.e., $L_{HR}>2*d_S$), and the length of the handle rails' shorter end (i.e., $L_{hr}$) is less than the step distance (i.e., $L_{hr}<d_S$).

The opposing side rails 12 and handle rails 24 are tubular and preferably have substantially circular cross-sections. Generally, the side rails diameter ($D_{SR}$) are greater than the handle rails diameter ($D_{HR}$) so that the free ends of the handle rails can fit within the interior tubular space 26 of the side rails. As particularly shown in FIGS. 2A and 2B, the handle rails have alternative configurations depending on which end is inserted into the opposing side rails. As particularly shown in FIG. 2A, the shorter end is inserted into the opposing side rails and the longer end extends upward from the opposing side rails. Alternatively, as shown in FIG. 2B, the longer free end is inserted into the opposing side rails and the shorter first free extends upward from the opposing side rails.

The body 20 of each bracket has a bottom end 20*a*, a top end 20*b*, a longitudinal base 28 extending from the bottom end to the top end, and an outward facing surface 30. The longitudinal base is attached to the top section of the ladder side rails. The outward facing surface extends a distance from the bottom end towards the top end where the arm 22 extends out from the body. As shown in FIG. 4B, the outward facing surface preferably engages the rub rail along the entirety of this distance which is shown in the drawings and referred to herein as the engagement distance ($d_E$). The engagement distance is less than a body length ($L_B$) of the longitudinal base between the top end and the bottom end (i.e., $d_E<L_B$).

The arm 22 has a fixed end 22*a*, a free end 22*b*, and an inward facing surface 32 and extends an arm length ($L_A$) along the inward facing surface from the fixed end to a tip 34 of the arm at the free end adjacent to the bottom end of the body. The fixed end is attached to the body proximate to the top end, and the inward facing surface is spaced from and substantially parallel to the outward facing surface for at least one half of the engagement distance, forming a slot 36 between the arm and the body. The slot receives and engages the trailer's rub rail 100 through a flared space 38 at its open end 36*a* between the inward facing surface and the outward facing surface proximate to the free end of the arm and the bottom end of the base.

Preferably, the flared space is formed by a taper 40 to the tip in the free end of the arm to maximize the length of the engagement distance between the base side of the bracket and the rub rail, i.e., the entire outward facing surface in the slot engages the front face of the rub rail. However, it will be appreciated that the flared space could also be formed by a cutaway 40' in the outward facing surface towards the open end of the slot or by a combination of a taper in the free end of the arm with a cutaway in the outward facing surface. The slot is preferably skewed by a slot angle ($\alpha_S$) that is between ten degrees and fifteen degrees (10°-15°) relative to the longitudinal base of the bracket which engages the vertical side of the trailer's rub rail, and the taper at end of the arm preferably has a taper angle ($\alpha_T$) that is between fifteen degrees and twenty degrees (15°-20°) to produce a flare angle ($\alpha_F$) between five degrees and ten degrees (5°-10°) relative to the parallel sides of the slot's fixed width section 36*b*. The skewed slot angle results in the ladder's side rails being angled between seventy-five degrees and eighty degrees (75°-80°) relative to the horizontal plane of the ground.

Figure 3A:
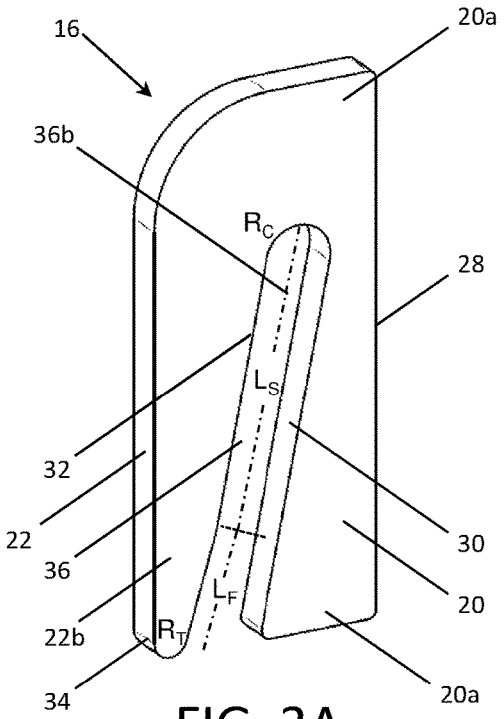
FIG. 3A is a perspective view of the mounting bracket described herein and FIGS. 3B-3E are detail views of the mounting bracket on a rail of the hang ladder.
Figure 3C:
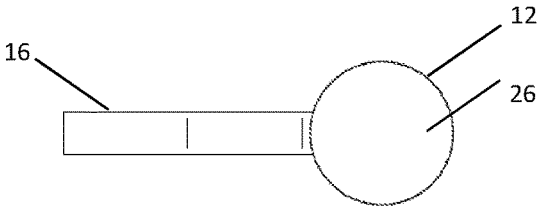
Figure 3D:
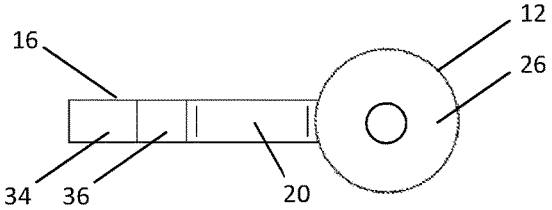
Figure 3B:
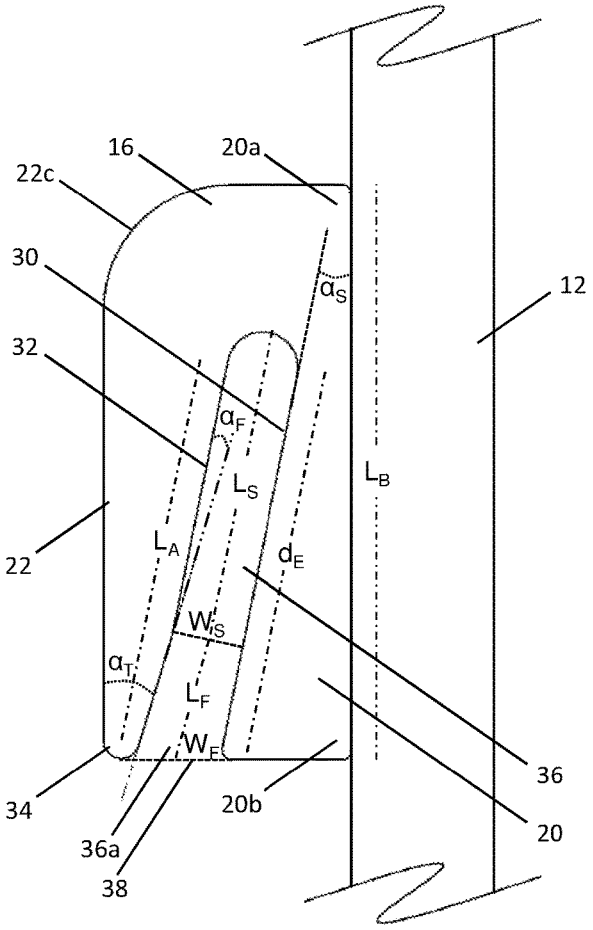
Figure 3E:
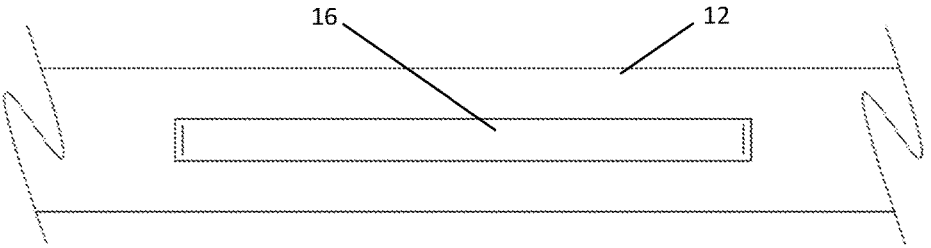

In the particular embodiment shown in FIG. 3B, the flare angle is five and one-half degrees ($\alpha_F$=5.5°) relative to the parallel sides of the slot, and the slot angle is eleven degrees ($\alpha_S$=11°) which results in the ladder's side rails being angled seventy-nine degrees (79°) from the horizontal ground plane when the rub rails are in a substantially vertical orientation. The fixed width section 36*b* of the slot between the parallel inward facing surface and outward facing surface has a slot length that is approximately twice the flare length ($L_S \approx 2*L_F$) and a slot width that is approximately one half the flare length of the flared space (i.e., the flare length is approximately twice the slot width, $L_F \approx 2*W_S$). Additionally, the flared space at the tip of the arm preferably has a flare width less than twice the slot width ($W_F<2*W_S$). The slot preferably includes a curved surface 36*c* proximate to the fixed end of the arm, and the tip of the arm has a radius of curvature less than a radius of curvature for the curved surface ($R_T$=0.125", $R_C$=0.25").

The body 20 and arm 22 of each bracket 16 have a substantially rectangular arrangement with a small radius of curvature (0.063 inches) at opposite ends of the longitudinal base, and the arm has a rounded upper end 22*c* with a relatively large radius of curvature (0.875 inches) where the arm connects to the body. The bracket has a length that is approximately 4 inches, a width that is approximately 1.65 inches, and a thickness that is approximately 5/16 inch. It will be appreciated to those having an ordinary skill in the art that the overall dimensions of the bracket may vary, and the preferred dimensions described herein is not intended to be limiting.

Figure 4A:
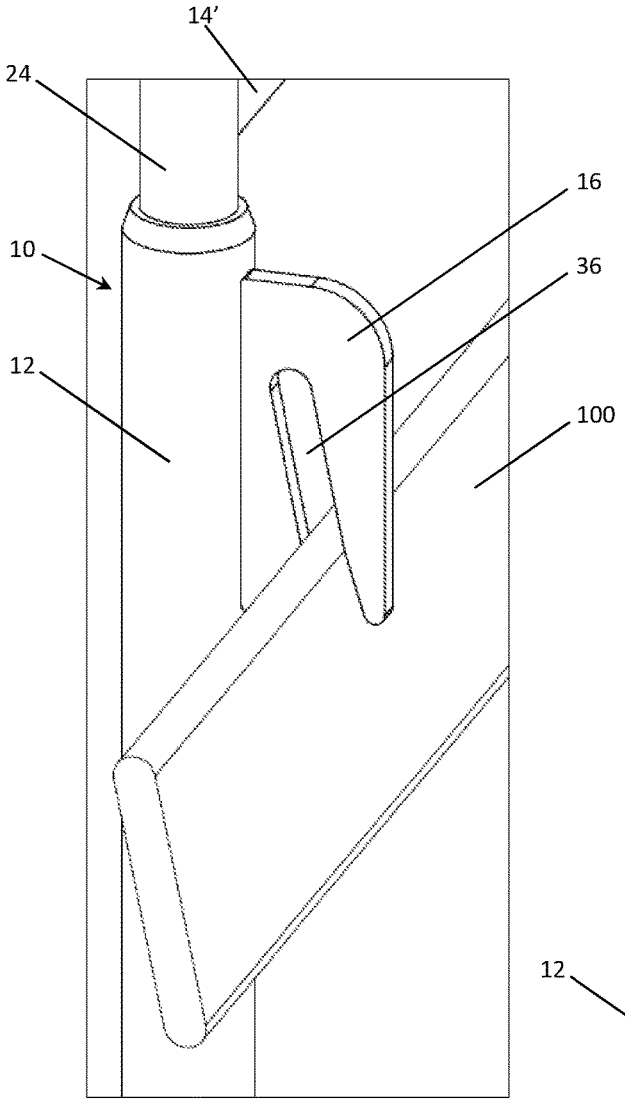
FIG. 4A is a perspective view of the mounting bracket on a side rail of the hang ladder as the bracket begins to be placed over the rub rail of a trailer.
Figure 4B:
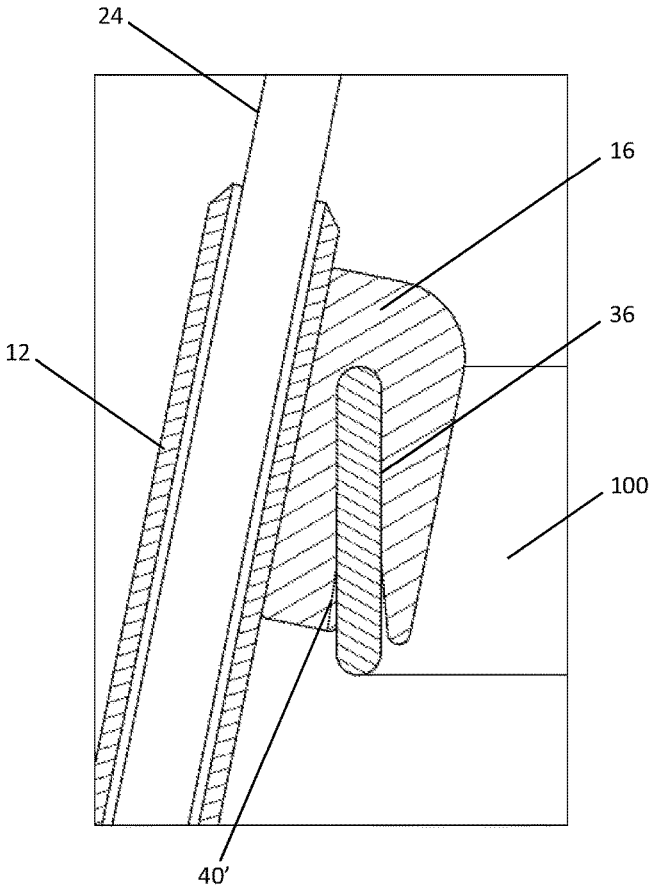
FIG. 4B is a cross-sectional view of the mounting bracket and the side rail when the bracket fully engages and is seated on the rub rail of the trailer.

As particularly shown in FIGS. 4A and 4B, the inflection point in the flare is positioned on the arm side of the slot which is opposite from the base side of the bracket that attaches to the vertical side rails of the ladder. Accordingly, it is an aspect of the invention to provide an arm with a tapered section at its distal end so that the slot expands from its fixed width section between the parallel sides to the flare width at its open end so that the wider opening is easier to place over the rub rails and can also receive rub rails of different sizes. When the rub rail is positioned within the tapered section, the taper guides the rub rail into the upper fixed width section of the slot until the top of the rub rail is seated against the curved surface at the top end of the slot and nearly the entire outward facing surface of the base engages the side face of the rub rail as particularly shown in FIG. 4B. The fixed width section between the parallel sides of the slot provides a secure engagement between the bracket and the rail and helps avoid rotation or rocking of the ladder.

When the rub rail 100 is seated within the slot 36, the hang ladder 10 is angled away from the vertical plane of the trailer's side. Accordingly, the bracket securely engages the rub rail and the ladder hangs therefrom. The outward facing surface which forms one side of the angled slot contacts the outer face of the rub rail and keeps the hang ladder at an acute angle relative to the vertical plane of the trailer when a person's weight is supported by the ladder, preventing the ladder from rotating past vertical. The ladder preferably has the multi-rung section and the handle extension section with at least one rung which can be rotated between a stowed position and a working position. For example, as shown in FIG. 2A, the handles may extend past the top rung of the ladder a distance meeting or exceeding OSHA's required three feet (3') for portable metal ladders. The handle extension section may be inverted and inserted into the vertical side rails of the ladder or completely removed when the ladder is stowed, as shown in FIG. 2B. Preferably, when the ladder is in use, the extension section is rotated so that the short rails are inserted into the hang ladder's tubular side rails and the long hand rails extend up from the top rung in the extension section. When the ladder is no longer needed, it is lifted until the bracket is free from the rub rail. The extension section of the ladder is preferably rotated so that the long rails are inserted into the hang ladder's tubular side rails to so that the ladder is more compact for stowage.

Figure 2C:
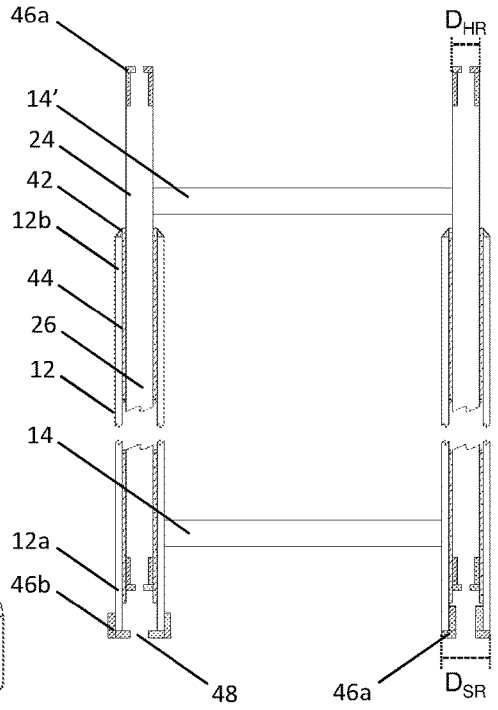
FIG. 2C is a cross-sectional view of the hang ladder shown in FIG. 2B.

Additional innovative features of the ladder and mounting brackets are shown in FIG. 2C, including a protective sleeve assembly with a steel ring 42 attached to a nylon sleeve 44 that fully extends into the vertical side rails of the ladder base to protect the powder coating on the top section of the ladder from being scratched and prevent rusting or other oxidation. Additionally, the plugs 46*a* and/or caps 46*b* on the ends of the vertical side rails of the ladder have drain holes 48 to allow water to escape and prevent interior rusting of the ladder. As shown, it is preferred that plugs which connect to the interior of the vertical rails are used on the top end and caps connecting on the outside of the vertical rails are used on the bottom. However, it will be appreciated that other variations of plugs and caps can be used.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the tubular side rails and the tubular handle rails have a circular cross-sectional shape, it will be appreciated that the cross-sectional shape could be oval, square, or rectangular, as long as the cross-sectional dimensions of the handle rails are sufficiently small than the side rails so the handle rails slide into the interior portion of the side rails. Thus, the breadth and scope of the present invention should not be limited by any of the above-described exemplary embodiments, but should be defined only in accordance with the following claims appended hereto and their equivalents.

What is claimed is:

1. A hang ladder for mounting to a trailer rub rail, comprising:

a pair of opposing side rails extending from a bottom section to a top section;

a plurality of rungs extending between and connecting the pair of side rails from the bottom section to the top section, wherein each rung in the plurality of rungs is adjacent to at least one other rung in the plurality of rungs and is spaced therefrom by a step distance;

a pair of brackets respectively attached to the top section of the opposing side rails, wherein each of the pair of brackets is comprised of a body and an arm extending from the body;

wherein the body comprises a bottom end, a top end, a longitudinal base extending from the bottom end to the top end, and an outward facing surface extending an engagement distance from the bottom surface towards the top end, wherein the engagement distance of the outward facing surface is less than a body length of the longitudinal base between the top and the bottom end, and wherein the longitudinal base is attached to the top section of the ladder side rails; and wherein the arm comprises a fixed end, a free end, and an inward facing surface, wherein the fixed end is attached to the body proximate to the top end, wherein the arm extends an arm length along the inward facing surface from the fixed end to a tip of the arm at the free end adjacent to the bottom end of the body, wherein the inward facing surface is spaced from and substantially parallel to the outward facing surface for at least one half of the engagement distance and forms a slot between the arm and the body, wherein the slot receives the rub rail, and wherein the slot is further comprised of a flared space between the inward facing surface and the outward facing surface proximate to the free end of the arm and the bottom end of the base.

2. The hang ladder of claim 1, wherein the flared space has a flare angle between five degrees and ten degrees outward from the inward facing surface.

3. The hang ladder of claim 2, wherein the slot is skewed relative to the longitudinal base by a slot angle between ten degrees and fifteen degrees.

4. The hang ladder of claim 1, wherein the slot is further comprised of a curved surface proximate to the fixed end of the arm, wherein the slot between the parallel inward facing surface and outward facing surface has a slot length and a slot width, wherein the flared space has a flare length approximately twice the slot width, wherein the slot length is approximately twice the flare length, and wherein the flared space at the tip of the arm has a flare width less than twice the slot width.

5. The hang ladder of claim 4, wherein the tip has a radius of curvature less than a radius of curvature for the curved surface in the slot.

6. The hang ladder of claim 1, wherein the flared space is formed by a taper in the free end of the arm.

7. The hang ladder of claim 6, wherein the taper has a taper angle between fifteen degrees and twenty degrees.

8. The hang ladder of claim 1, further comprising a pair of handle rails extending from the opposing side rails and at least one additional rung extending between and connecting the handle sections proximate to one end of the pair of handle rails, wherein a first free end of the handle rails is greater than twice the step distance, wherein a second free end of the handle rails is less than the step distance, wherein the opposing side rails are tubular with a substantially circular cross-section with a first diameter, wherein the handle rails are tubular with a substantially circular cross-section with a second diameter less than the first diameter, wherein the handle rails have a first configuration with the first free end fitting within the opposing side rails and the shorter second end extending upward from the opposing side rails, and wherein the handle rails have a second configuration with the second free end fitting within the opposing side rails and the longer first free end extending upward from the opposing side rails.

9. A hang ladder for mounting to a trailer rub rail, comprising:

a pair of opposing side rails extending from a bottom section to a top section;

a plurality of rungs extending between and connecting the pair of side rails from the bottom section to the top section, wherein each rung in the plurality of rungs is adjacent to at least one other rung in the plurality of rungs and is spaced therefrom by a step distance;

a pair of brackets respectively attached to the top section of the opposing side rails, wherein each of the pair of brackets is comprised of a body and an arm extending from the body;

wherein the body comprises a bottom end, a top end, a longitudinal base extending from the bottom end to the top end, and an outward facing surface extending an engagement distance from the bottom surface towards the top end, wherein the engagement distance of the outward facing surface is less than a body length of the longitudinal base between the top and the bottom end, and wherein the longitudinal base is attached to the top section of the ladder side rails; and wherein the arm comprises a fixed end, a free end, and an inward facing surface, wherein the fixed end is attached to the body proximate to the top end, wherein the arm extends an arm length along the inward facing surface from the fixed end to a tip of the arm at the free end adjacent to the bottom end of the body, wherein the inward facing surface is spaced from and substantially parallel to the outward facing surface for at least one half of the engagement distance and forms a slot between the arm and the body, wherein the slot receives the rub rail, wherein the slot is further comprised of a flared space between the inward facing surface and the outward facing surface proximate to the free end of the arm and the bottom end of the base, wherein the slot between the parallel inward facing surface and outward facing surface has a slot length and a slot width, wherein the flared space has a flare length approximately twice the slot width, and wherein the slot length is approximately equal to the engagement distance of the outward facing surface and approximately twice the flare length.

10. The hang ladder of claim 9, wherein the slot is further comprised of a curved surface proximate to the fixed end of the arm, wherein the flared space has a flare angle between five degrees and ten degrees outward from the inward facing surface, and wherein the slot is skewed relative to the longitudinal base by a slot angle between ten degrees and fifteen degrees.

11. The hang ladder of claim 10, wherein the tip has a radius of curvature less than a radius of curvature for the curved surface in the slot.

12. The hang ladder of claim 9, wherein the flared space is formed by a taper in the free end of the arm.

13. The hang ladder of claim 12, wherein the taper has a taper angle between fifteen degrees and twenty degrees.

14. The hang ladder of claim 9, further comprising a pair of handle rails extending from the opposing side rails and at least one additional rung extending between and connecting the handle sections proximate to one end of the pair of handle rails, wherein a first free end of the handle rails is greater than twice the step distance, wherein a second free end of the handle rails is less than the step distance, wherein the opposing side rails are tubular with a substantially circular cross-section with a first diameter, wherein the handle rails are tubular with a substantially circular cross-section with a second diameter less than the first diameter, wherein the handle rails have a first configuration with the first free end fitting within the opposing side rails and the shorter second end extending upward from the opposing side rails, and wherein the handle rails have a second configuration with the second free end fitting within the opposing side rails and the longer first free end extending upward from the opposing side rails.

15. A hang ladder for mounting to a trailer rub rail, comprising:

a pair of opposing side rails extending from a bottom section to a top section;

a plurality of rungs extending between and connecting the pair of side rails from the bottom section to the top section, wherein each rung in the plurality of rungs is adjacent to at least one other rung in the plurality of rungs and is spaced therefrom by a step distance;

a pair of brackets respectively attached to the top section of the opposing side rails, wherein each of the pair of brackets is comprised of a body and an arm extending from the body;

wherein the body comprises a bottom end, a top end, a longitudinal base extending from the bottom end to the top end, and an outward facing surface extending an engagement distance from the bottom surface towards the top end, wherein the engagement distance of the outward facing surface is less than a body length of the longitudinal base between the top and the bottom end, and wherein the longitudinal base is attached to the top section of the ladder side rails; and wherein the arm comprises a fixed end, a free end, and an inward facing surface, wherein the fixed end is attached to the body proximate to the top end, wherein the arm extends an arm length along the inward facing surface from the fixed end to a tip of the arm at the free end adjacent to the bottom end of the body, wherein the inward facing surface is spaced from and substantially parallel to the outward facing surface for at least one half of the engagement distance and forms a slot between the arm and the body, wherein the slot receives the rub rail, wherein the slot is comprised of a flared space between the inward facing surface and the outward facing surface proximate to the free end of the arm and the bottom end of the base, and wherein the flared space is formed by a taper in the free end of the arm.

16. The hang ladder of claim 15, wherein the flared space has a flare angle between five degrees and ten degrees outward from the inward facing surface.

17. The hang ladder of claim 16, wherein the slot is skewed relative to the longitudinal base by a slot angle between ten degrees and fifteen degrees.

18. The hang ladder of claim 15, wherein the slot is further comprised of a curved surface proximate to the fixed end of the arm, wherein the slot between the parallel inward facing surface and outward facing surface has a slot length and a slot width, wherein the flared space has a flare length approximately twice the slot width, wherein the slot length is approximately twice the flare length, and wherein the flared space at the tip of the arm has a flare width less than twice the slot width.

19. The hang ladder of claim 18, wherein the tip has a radius of curvature less than a radius of curvature for the curved surface in the slot.

20. The hang ladder of claim 15, wherein the taper has a taper angle between fifteen degrees and twenty degrees.

* * * * *